United States Patent [19]

Scire et al.

[11] 4,077,685

[45] Mar. 7, 1978

[54] COMBINATION CUTTING BOARD AND DRAWER

[76] Inventors: Ronald Scire; Felicetta Scire, both of 145 Alder Dr., Kings Park, N.Y. 11754

[21] Appl. No.: 738,035

[22] Filed: Nov. 2, 1976

[51] Int. Cl.[2] ..... A61B 19/02

[52] U.S. Cl. ..... 312/246; 312/322; 312/237; 312/211; 312/330 R

[58] Field of Search ..... 312/204, 209, 211, 237, 312/246, 248, 291, 292, 307, 322

[56] References Cited

U.S. PATENT DOCUMENTS

| | | | |
|---|---|---|---|
| 132,165 | 10/1872 | Maples | 312/246 |
| 157,283 | 12/1874 | Gurney | 312/237 |
| 363,372 | 5/1887 | Dollens | 312/291 |
| 883,990 | 4/1908 | Warren | 312/211 |
| 1,436,546 | 11/1922 | Stephens | 312/322 |
| 2,786,337 | 3/1957 | Spring | 312/237 |
| 3,290,105 | 12/1966 | Nall | 312/209 |
| 3,428,383 | 2/1969 | Nobel | 312/209 |
| 3,464,749 | 9/1969 | Bishop | 312/248 |

*Primary Examiner*—Casmir A. Nunberg
*Attorney, Agent, or Firm*—charles J. Speciale

[57] ABSTRACT

The combination of a cutting board and a removable drawer, the drawer being adapted to have the dual capacity of functioning as storage means and/or dispensing means.

4 Claims, 3 Drawing Figures

COMBINATION CUTTING BOARD AND DRAWER

BACKGROUND OF THE INVENTION

1. Field of the Invention

This invention relates generally to cutting boards and more particularly, to an improved cutting board provided with a removable drawer which is itself specially adapted.

2. Description of the Prior Art

Cutting boards of various sizes and shapes are of course well known in the kitchen as well as in food stores, such as butcher shops groceries or delicatessens, and in restaurants. These cutting boards come provided with cutlery racks, trays, juice reservoirs and sliding cutting surfaces merely to name some typical variations. None has been yet disclosed, however, which combines the cutting or chopping operation with storage means for the cut or chopped food while more is being prepared and for the dispensing of the prepared food from the storage means.

SUMMARY OF THE INVENTION

It is therefore, among of the principal objectives of this invention to provide an improved cutting board having not only the cutting surface but also storage and/or dispensing means for the stored food material.

In accord with the invention there is now provided the combination of a cutting board for slicing or chopping food material such as meat, bread or vegetables including a cutting surface therefor, and a drawer removably slidingly inserted into the body of said cutting board, said drawer being adapted to have the dual capacity of acting as storage means and/or dispensing means for the sliced or chopped food material. Said drawer can also act as storage means for cutlery when not in use and a lock for safely storing said cutlery is also provided.

BRIEF DESCRIPTION OF THE DRAWING

The invention will be hereinafter more fully described with reference to the accompanying drawing in which.

DESCRIPTION OF THE PREFERRED EMBODIMENT

Figure 1:
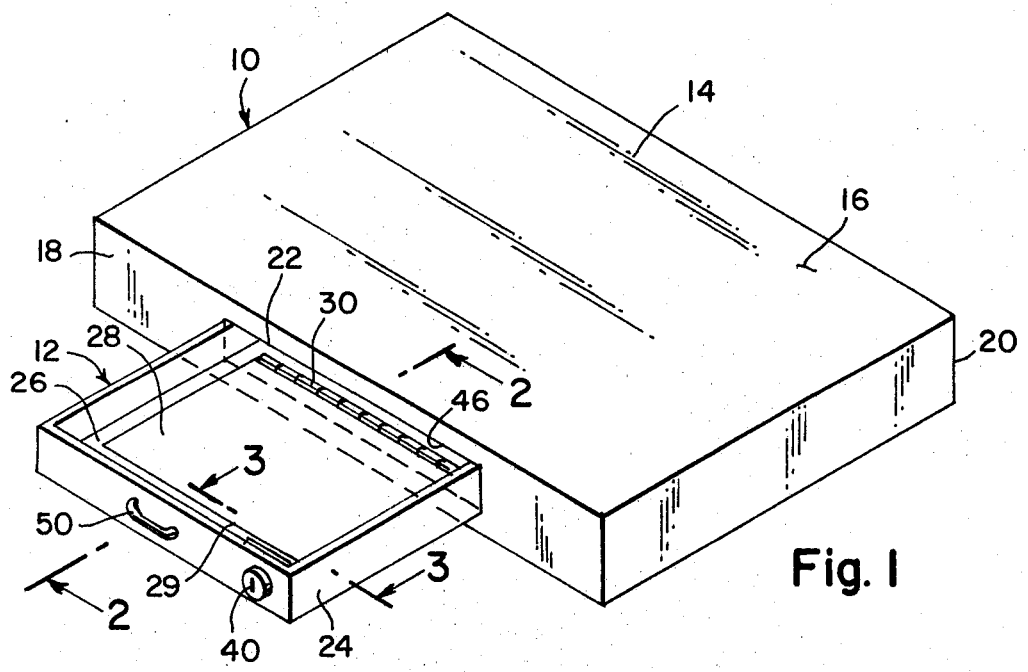
FIG. 1 is a view in perspective of the inventive combination and drawer with the drawer shown in the open position.

Referring now to the figures of the drawing, there is illustrated therein the inventive combination cutting board and drawer which includes the cutting board 10 and drawer 12. The cutting board comprises a solid main board structure 14 formed of hard wood, plastic or the like. Main board structure 14 further comprises a cutting surface 16 and a pair of parallel opposing front and rear walls 18 and 20, respectively. A recess 22 is provided, in a generally central location, through said front wall 18 and extending into the body of the main board structure 14.

Figure 2:
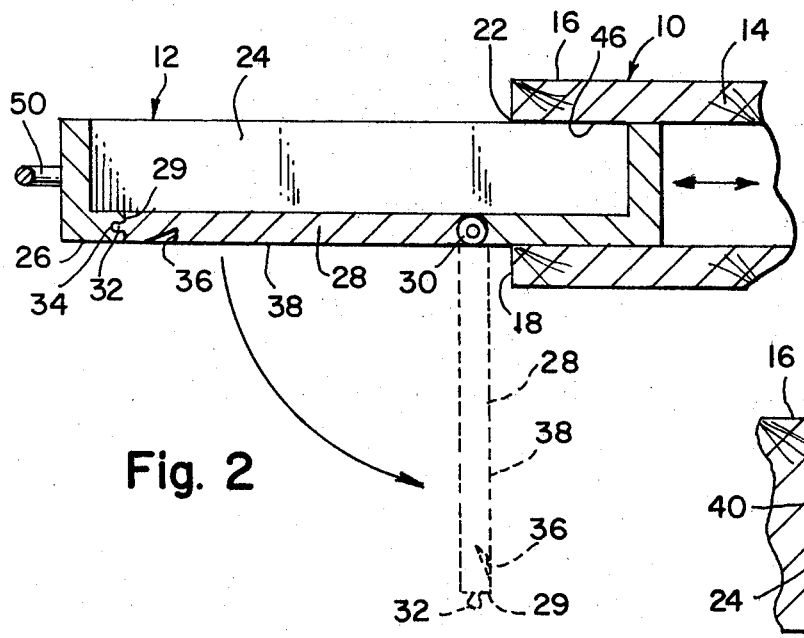
FIG. 2 is a sectional view taken along line 2—2 of FIG. 1 in the direction of the arrows.
Figure 3:
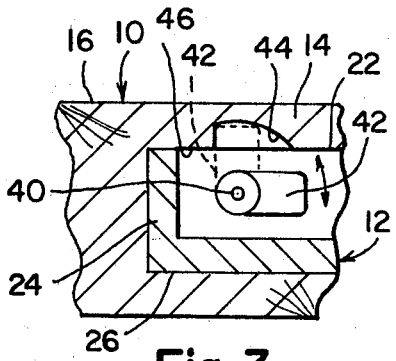
FIG. 3 is a sectional view, fragmented and taken along line 3—3 of FIG. 1 in the direction of the arrows.

Recess 22 is of a shape and size such that it will removably, slidingly receive a drawer structure 24. Drawer structure 24 is of conventional drawer construction except for one critical feature, and that is a major portion of the bottom 26 of the drawer structure is adapted to act as a "trap door" as it were. The trap door of the bottom of the drawer, identified as reference numeral 28 is adapted, by means of a longitudinal hinge 30 secured to the rear of part 28 to drop down from the drawer structure in hingeable rotation in the direction of the arrow (FIG. 2). Trap door 28 is also provided on its leading end portion 29 with a male snap lock nipple 32 which detachably engages with a female snap lock counterpart 34 forming a male/female snap lock assembly. An indented finger grip 36 is provided on the underside portion 38 of trap door 28, for pulling the trap door down and disengaging the male/female snap lock assembly. Of course, in order to drop the trap door 28 the drawer 12 must be slid out of the recess 22 to an extent that hinge 22 clears the front wall 18 of the main board structure 14. When the cutting board and drawer are not in use, the drawer may be used to store cutlery such as sharp knives and cleavers (not shown) and a lock 40 may be provided to safely store these articles inaccessible to children. Lock 40 has a 90° rotatable arm 42 which keyingly secures into a curved recess 44 provided just inside the upper wall 46 of recess 22.

Describing now the unique features of this invention in operation when it is desirous to chop some vegetables on surface 16 of cutting board 14 what is done is to remove the cutlery stored in the drawer 12, if any. The food is then chopped and the drawer pulled out as in FIG. 2. As the food is being prepared it may be scraped into open drawer 12 and stored until ready for dispensing. When it is desired to dispense the chopped vegetables in the drawer to the cooking pot all that need be done is to put the pot or the pan under the trap door 28 and the same is then pulled down via finger grip 36 allowing the food material to drop neatly into the cooking utensil. Alternatively, waste food may be stored in the drawer during chopping or slicing on the cutting board and when finished the waste is similarly dropped but this type into a garbage receptacle Still further, the drawer can be pulled out all the way and carried to the dispensing area. The drawer is then rinsed and the trap door engaged by the male/female lock assembly. A handle 50 is provided on the front of the drawer for carrying it when empty, if desired, or for sliding it out of its recess.

What is claimed is:

1. In combination a cutting board including a main board structure and a cutting surface, for slicing or chopping food material, and a drawer removably, slidingly insertable into said main board structure, said drawer being adapted to have the dual capacity of acting as storage means and dispensing means for the prepared food material.

2. The combination of claim 1, wherein said main board structure further includes a recess provided therein, and wherein said drawer further comprises a drawer structure having two pairs of parallel, opposing side walls, an open top and a bottom whose major portion comprises a hinged trap door detachably engageable with said bottom, said drawer structure fitting into said recess.

3. The combination of claim 2, wherein said trap door has an underside portion, a finger grip being provided therein for detaching said trap door from its engaged position.

4. The combination of claim 2, wherein said drawer structure is adapted to be lockingly secured inside said recess.

* * * * *